US006027274A

United States Patent [19]

Seddon et al.

[11] Patent Number: 6,027,274

[45] Date of Patent: Feb. 22, 2000

[54] MARKING INSTRUMENTS

[75] Inventors: Mark Arthur Seddon, Reading; Roy Nicoll, Wokingham, both of United Kingdom

[73] Assignee: The Gillette Company, Boston, Mass.

[21] Appl. No.: 09/096,818

[22] Filed: Jun. 12, 1998

Related U.S. Application Data

[63] Continuation of application No. PCT/US96/19877, Dec. 12, 1996.

[30] Foreign Application Priority Data

Dec. 15, 1995 [GB] United Kingdom ..... 9525695

[51] Int. Cl.[7] ..... B43K 5/18

[52] U.S. Cl. ..... 401/206; 401/148

[58] Field of Search ..... 401/148, 206, 401/264; 251/349, 331, 325, 339, 353

[56] References Cited

U.S. PATENT DOCUMENTS

| | | | |
|---|---|---|---|
| 2,557,917 | 6/1951 | Schlesinger | 401/264 |
| 2,762,337 | 9/1956 | Beckwith | 401/148 |
| 2,996,750 | 8/1961 | Cholet | 401/206 |
| 4,973,180 | 11/1990 | Hori | 401/141 |
| 5,249,875 | 10/1993 | Hori et al. | 401/148 |

FOREIGN PATENT DOCUMENTS

| | | | |
|---|---|---|---|
| 0556440 | 8/1993 | European Pat. Off. . | |
| 6-92083 | 4/1994 | Japan | 401/206 |
| 9305966 | 4/1993 | WIPO . | |

*Primary Examiner*—Charles R. Eloshway
*Attorney, Agent, or Firm*—Fish & Richardson P.C.

[57] ABSTRACT

A marking instrument includes a reservoir chamber for marking fluid, a channel for conducting marking fluid from the reservoir chamber for supply to a marking tip, and a valve for controlling supply of fluid through the channel. The valve includes a seat member with a port, a diaphragm having an edge for cooperation with the seat member to close the port, and a free surface extending from the edge to a position at which the diaphragm is held against movement. The seat member is movable to deflect the diaphragm for opening the valve. The free diaphragm surface extends away from the edge at an angle of 45° to 85° when the valve is closed.

6 Claims, 2 Drawing Sheets

MARKING INSTRUMENTS

This application is a continuation of prior application PCT/US96/19877 which was filed on Dec. 12, 1996.

This invention relates to marking instruments, and especially although not necessarily exclusively writing instruments, which term is intended to encompass board markers and highlighters as well as different types of reservoir pen.

In WO 93/05966, there is described a marking instrument having a reservoir chamber for storing marking fluid, a feed channel for conducting fluid to a marking tip from the reservoir chamber, and a valve for controlling flow of fluid through the channel. The channel is defined through a feed device which carries the marking tip and is able to move axially. The feed device includes adjacent to its inner end a radially directed port, and an annular diaphragm surrounds the feed device with its inner edge arranged to close the port to shut off communication between the reservoir chamber and the feed channel. When the marking tip is pressed against a surface, the feed device retracts causing the diaphragm to deflect so that the marking fluid in the reservoir chamber is pressurized and the inner edge of the diaphragm lifts away from the feed device to open the port and allow fluid to enter the feed channel and pass to the marking tip. This marking instrument has been found to be effective in the control and delivery of marking fluid. However, for some applications the distance through which the feed device must be displaced has been found undesirably high and the resulting diaphragm deflection can cause excessive fluid to be pumped to the marking tip by the pressure generated in the reservoir chamber.

The present invention aims to eliminate, or at least alleviate this drawback and in accordance with the invention there is provided a marking instrument comprising a reservoir chamber for marking fluid, a channel for conducting marking fluid from the reservoir chamber for supply to a marking tip, and a valve for controlling supply of fluid through the channel, the valve comprising a seat member with a port, and a diaphragm having an edge for co-operation with the seat member to close the port, and a free surface extending from said edge to a position at which the diaphragm is held against movement, the seat member being movable to deflect the diaphragm for opening the valve, and the said free diaphragm surface extends away from said edge at an angle of 45° to 85° when the valve is closed.

The diaphragm could be a flap with a linear edge which co-operates with the valve seat, but in the preferred construction the diaphragm is annular and the seat member is a core which extends through the central aperture of the diaphragm and is guided to move axially for opening and closing the valve.

The core which extends through the diaphragm could be frusto-conical, but in the presently preferred construction it is cylindrical with one or more radial ports.

The free surface of the diaphragm preferably extends away from the edge at an angle in the range of 55° to 75°, and ideally at an angle of 60° to 70°.

With the diaphragm inclined in accordance with the invention the displacement of the valve seat member needed to open the valve can be substantially reduced. Furthermore, the valve operation less sensitive to dimensional variations due to manufacturing tolerances than a flat radial diaphragm.

A clear understanding of the invention will be gained from the following detailed description of an exemplary embodiment, reference being made to the accompanying drawings in which.

Figure 1:
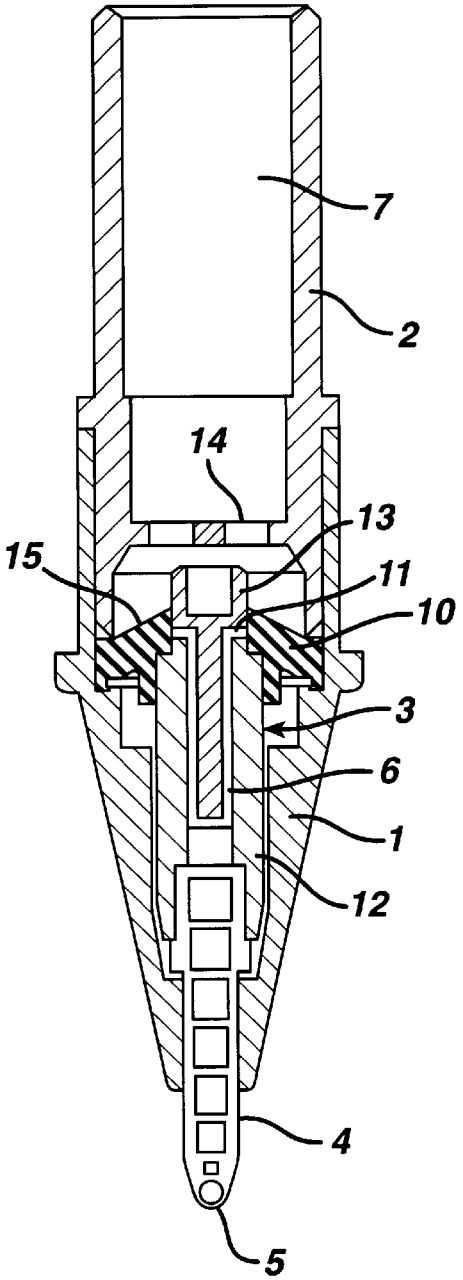
FIG. 1 is an axial section through a forward end portion of a writing instrument embodying the invention and showing the valve in its normal closed condition.
Figure 2:
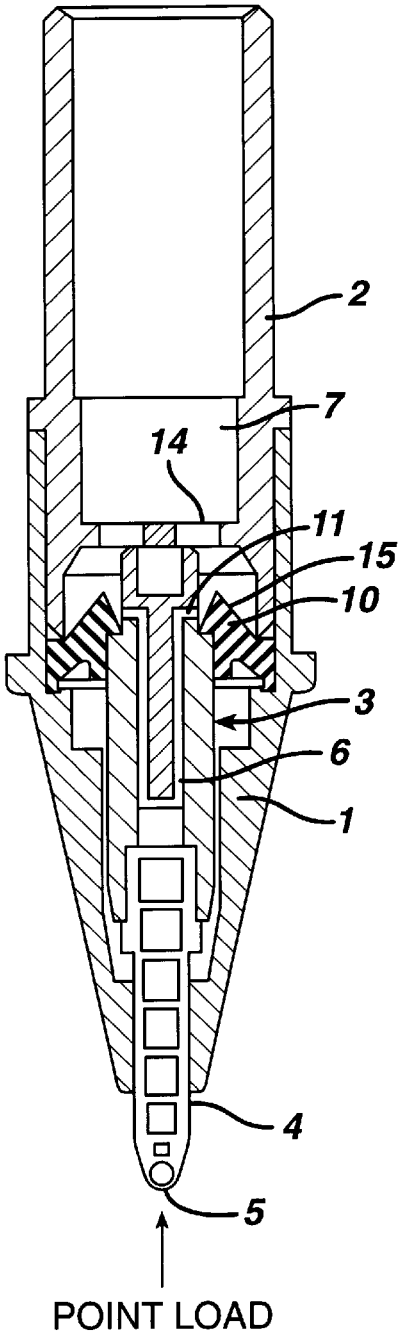
FIG. 2 is an axial section showing the writing instrument of FIG. 1 with the valve fully opened.

The marking instrument illustrated in FIGS. 1 and 2 has a body with front and rear parts 1, 2 which are connected securely together. Axially slidably guided in a bore extending through the front body part 1 is a feed device 3 to the forward end of which is attached a marking tip 4 which extends slidably through the front end of the body part 1 to a marking point 5. As shown the marking point is a ball point, but any form of marking tip commonly used in reservoir pens, including fibre tips, felt tips, tubular nibs, etc could be used. The feed device 3 includes an ink feed channel 6 for conducting ink to the marking tip from a reservoir chamber 7, the forward end portion of which is defined by the rear body part 2. It will be understood that a reservoir housing will be fitted to the rear body part 2 to enclose fully the reservoir chamber, and this housing can be provided with a grease plug follower, as described in WO 93/05966, so that the volume of the reservoir chamber diminishes as the ink is used. The forward end of the reservoir chamber is delimited by a diaphragm 10 having an outer edge portion clamped between the two body parts 1, 2 so that the diaphragm provides a seal against leakage of ink between these parts. The rear end of the feed device includes a cylindrical portion forming a valve seat at which open four radial ports 11 uniformly distributed about the cylindrical seat surface and connected with the feed channel 6. Conveniently the feed device 3 is assembled from a sleeve member 12 with an axial through bore, and a plug 13 which is fitted into the rear end of the bore and defined the ports 11 with the sleeve member. The sleeve member has an external radial shoulder a short distance in front of the ports 11, and the inner peripheral edge of the diaphragm 10 engages the valve seat surface behind this shoulder so that the diaphragm covers and closes the ports 11 to shut off communication between the reservoir chamber 7 and the feed channel 6 in a normal condition of the writing instrument, as shown in FIG. 1. The diaphragm includes, an integral sleeve portion which projects forwardly and surrounds the feed device forwardly of the ports 11 to provide an additional seal to prevent leakage of ink between the diaphragm and feed device. The feature is also described in our co-pending UK Patent Application No 9513391.4, and as also described in that application the feed device could include a recess between the shoulder and the ports 11 for causing ink to be drawn back from the marking tip after closure of the valve.

In use of the marking instrument the marking point is applied to a surface to be written on and under the force exerted on the marking point, the marking tip 4 and feed device 3 are displaced rearwardly relative to the body. As a result the diaphragm 10 is deflected rearwardly, causing a pressurization of the ink in the chamber 7, and the inner edge of the diaphragm is deflected so that the ports 11 are uncovered and comnmunication between the reservoir chamber and ink feed channel is established allowing ink to pass to the marking tip through the open valve. The rearward displacement of the feed device is limited by a stop which is formed by a perforated wall 14 integral with the rear body part 2. When the marking point is lifted from the paper surface, the feed device and marking tip are returned to their initial positions in which the valve is closed.

Figure 3:
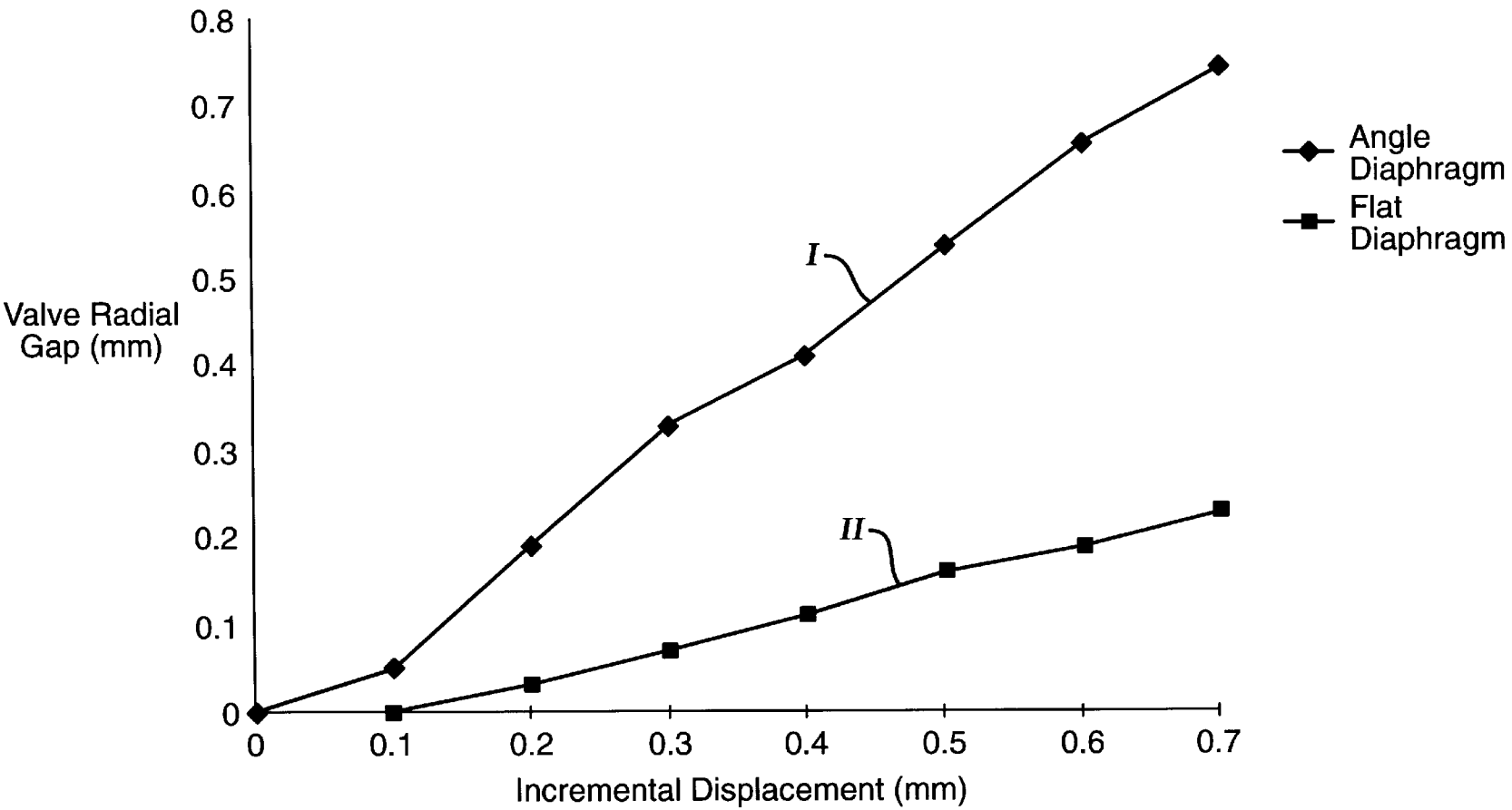
FIG. 3 is a graph showing the radial gap created between the diaphragm and the valve seat plotted against axial displacement of the valve seat member for a valve embodying the invention and a prior art valve with a flat diaphragm.

In accordance with the invention the free surface 15 of the diaphragm confronting the reservoir chamber 7 extends at an angle less than 90°, and in particular about 60°, to the inner edge surface which co-operates with the cylindrical surface of the valve seat. Due to this frusto-conical configuration of the diaphragm, the displacement of the feed device needed to open the valve is reduced compared with that of the flat valve. This effect is illustrated in FIG. 3 in which the upper line I applies to a valve with an inclination angle of 30° to the radial direction and an interference fit of 0.1 mm with the valve seat, and line II applies to a corresponding flat valve. It can be seen that with a diaphragm according to the invention the valve opens much more rapidly with rearward displacement of the marking tip, and hence the reciprocal stroke of the marking tip required to obtain correct valve operation is reduced and the movement of the marking point will be less noticeable to the user of the instrument.

We claim:

1. A marking instrument comprising a reservoir chamber for marking fluid, a channel for conducting marking fluid from the reservoir chamber for supply to a marking tip, and a valve for controlling supply of fluid through the channel, the valve comprising a seat member with a port, and a diaphragm having an edge for co-operation with the seat member to close the port, and a free surface extending from said edge to a location at which the diaphragm is held against movement, the seat member being movable to deflect the diaphragm for opening the valve, and the free diaphragm surface extending away from the location at an angle of 45° to 85° to a wall of said instrument when the valve is closed.

2. A marking instrument according to claim 1, wherein the free surface of the diaphragm extends away from the wall at a angle of 55° to 75° when the valve is closed.

3. A marking instrument according to claim 2, wherein the free surface of the diaphragm extends away from the wall at a angle of 60° to 70° when the valve is closed.

4. A marking instrument according to claim 1, wherein the diaphragm is annular with a central aperture, and the seat member extends through said central aperture and is guided to move axially for opening and closing the valve.

5. A marking instrument according to claim 4, wherein the portion of the seat member extending through the diaphragm has a cylindrical surface and the port is directed radially with respect to the cylindrical surface.

6. A marking instrument according to claim 4, wherein the valve seat member has a radial shoulder, a surface of the diaphragm opposite the free surface abuts the shoulder, and the diaphragm includes an integral sleeve portion in sealing co-operation with a feed device through which the channel extends forwardly of the shoulder.

* * * * *